US007350325B1

(12) United States Patent
Wang

(10) Patent No.: US 7,350,325 B1
(45) Date of Patent: Apr. 1, 2008

(54) STRUCTURE OF A PUBLICITY SCROLL

(76) Inventor: Li-Chen Wang, No. 29, Alley 96, Lane 288, Yunong Rd., Tainan City (TW)

( * ) Notice: Subject to any disclaimer, the term of this patent is extended or adjusted under 35 U.S.C. 154(b) by 0 days.

(21) Appl. No.: 11/651,982

(22) Filed: Jan. 11, 2007

(51) Int. Cl.
*G09F 11/18* (2006.01)

(52) U.S. Cl. ..... 40/515; 40/514; 40/604

(58) Field of Classification Search ..... 40/514–517, 40/604, 586, 597, 541; 362/34, 555, 812
See application file for complete search history.

(56) References Cited

U.S. PATENT DOCUMENTS 1,863,569 A * 6/1932 House ..... 40/517
1,872,737 A * 8/1932 House ..... 40/517
2,506,209 A * 5/1950 Glass ..... 40/514
6,038,800 A * 3/2000 Seidel ..... 40/517
6,663,255 B1 * 12/2003 Carito ..... 362/34
2002/0131275 A1 * 9/2002 Yamamoto et al. ..... 362/555
2005/0081413 A1 * 4/2005 Ko ..... 40/514
2006/0207142 A1 * 9/2006 Kochan et al. ..... 40/604

* cited by examiner

*Primary Examiner*—William L. Miller
(74) *Attorney, Agent, or Firm*—Rosenberg, Klein & Lee

(57) ABSTRACT

A scroll for publicity includes a housing sleeve, a banner, a winding mechanism, and a pulling rod; the banner is printed with words and images; the winding mechanism is housed in the housing sleeve, and connected to one end of the banner for rolling up the banner; the winding mechanism includes a connecting pipe connected to the banner, and a torsion spring positioned in the connecting pipe; the banner is normally wound around the connecting pipe; when the pulling rod is being moved away from the housing sleeve to spread out the banner for showing the words and images for publicity, rotational energy will be stored in the torsion spring; the banner will be automatically rolled up around the connecting pipe, and the scroll closed after the user stops exerting force on the pulling rod.

9 Claims, 8 Drawing Sheets

STRUCTURE OF A PUBLICITY SCROLL

BACKGROUND OF THE INVENTION

1. Field of the Invention

The present invention relates to a publicity scroll, more particularly one, which can be fixed/held in such a position as to allow words and images printed on a publicity banner thereof to be clearly seen.

2. Brief Description of the Prior Art

When organizations and companies need to make people know about their people (for example, candidates for elections, politicians and performing artists), services, events, activities, goods or themselves, they would use publicity and advertising. The information can be shown on advertising boards, posters, advertising screens, publicity flags or banners. Publicity flags and banners are inexpensive, and easy to manufacture and carry therefore they are used a lot on many occasions.

However, such banners aren't convenient to use because they have to be fixed to stationary objects by means of ropes if necessary, and the users have to hold the lateral edges of the banners in order to allow them to spread out and wave the banners. Furthermore, it is difficult for the users to keep the banners flat when the users hold the lateral edges of the banners to spread out the banners. Consequently, publicity words and images on the banners can't be clearly seen.

Second, wrinkles are prone to form on such banners to spoil the appearance of the banners after the banners are folded up for storage. Third, people may use other devices such as whistles and glow sticks to attract more attention while using such publicity banners in certain kinds of events. Therefore, they still have to buy and carry separate whistles and glow sticks if such conventional banners are used.

Therefore, it is a main object of the present invention to provide a scroll for publicity to overcome the above-mentioned problems, thus providing people with more convenience.

SUMMARY OF THE INVENTION

A publicity scroll according to a preferred embodiment of the present invention includes a housing sleeve, a banner, a winding mechanism, and a pulling rod. The banner is printed with words and images. The winding mechanism is housed in the housing sleeve, and connected to one end of the banner. The winding mechanism includes a connecting pipe joined to the banner, and a torsion spring positioned in the connecting pipe. The banner is normally wound around the connecting pipe; when the pulling rod is being moved away from the housing sleeve to spread out the banner for showing the words and images on the banner for publicity, rotational energy will be stored in the torsion spring; therefore, the banner will be automatically wound around the connecting pipe after the pulling rod is released.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
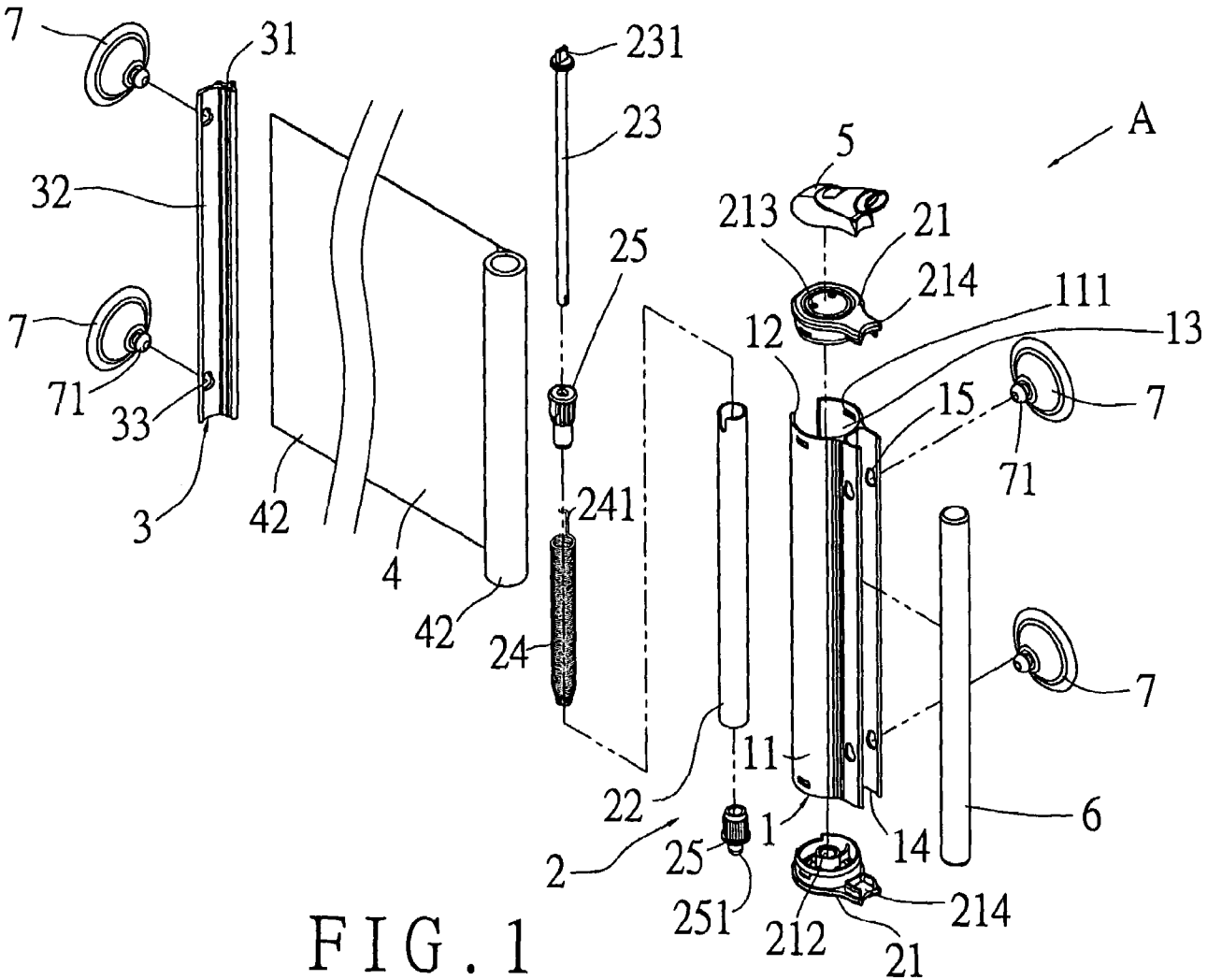
FIG. 1 is an exploded perspective view of the present invention.

Referring to FIG. 1, a preferred embodiment of a publicity scroll (A) of the present invention includes a housing sleeve 1, a winding mechanism 2, a pulling rod 3, a banner 4, a whistle 5, a light-producing member 6, and fixing units 7.

The winding mechanism 2 is held in the housing sleeve 1. The banner 4 is interposed between and connected to the winding mechanism 2 and the pulling rod 3. The whistle 5 and the light-producing member 6 are positioned on the housing sleeve 1. And, the fixing units 7 are each fitted on either the housing sleeve 1 or the pulling rod 3.

The housing sleeve 1 is a hollow cylinder-shaped housing 11, which has an internal space 13, and has on one side thereof a lengthways extending gap 12 communicating with the internal space 13. The housing sleeve 1 further has connecting holes 111 on upper and lower ends thereof, a hollow receiving portion 14 on the other side, and connecting holes 15 on lateral sides of the hollow receiving portion 14.

Figure 2:
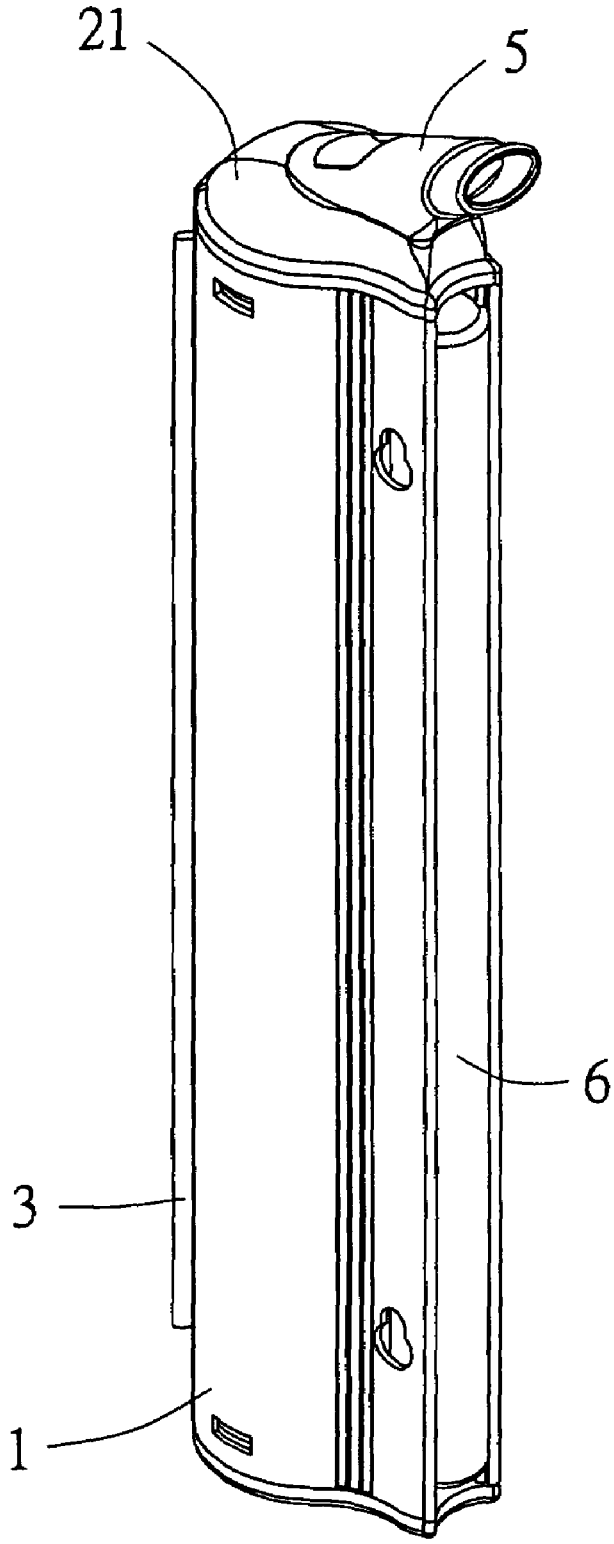
FIG. 2 is a perspective view of the present invention.
Figure 3:
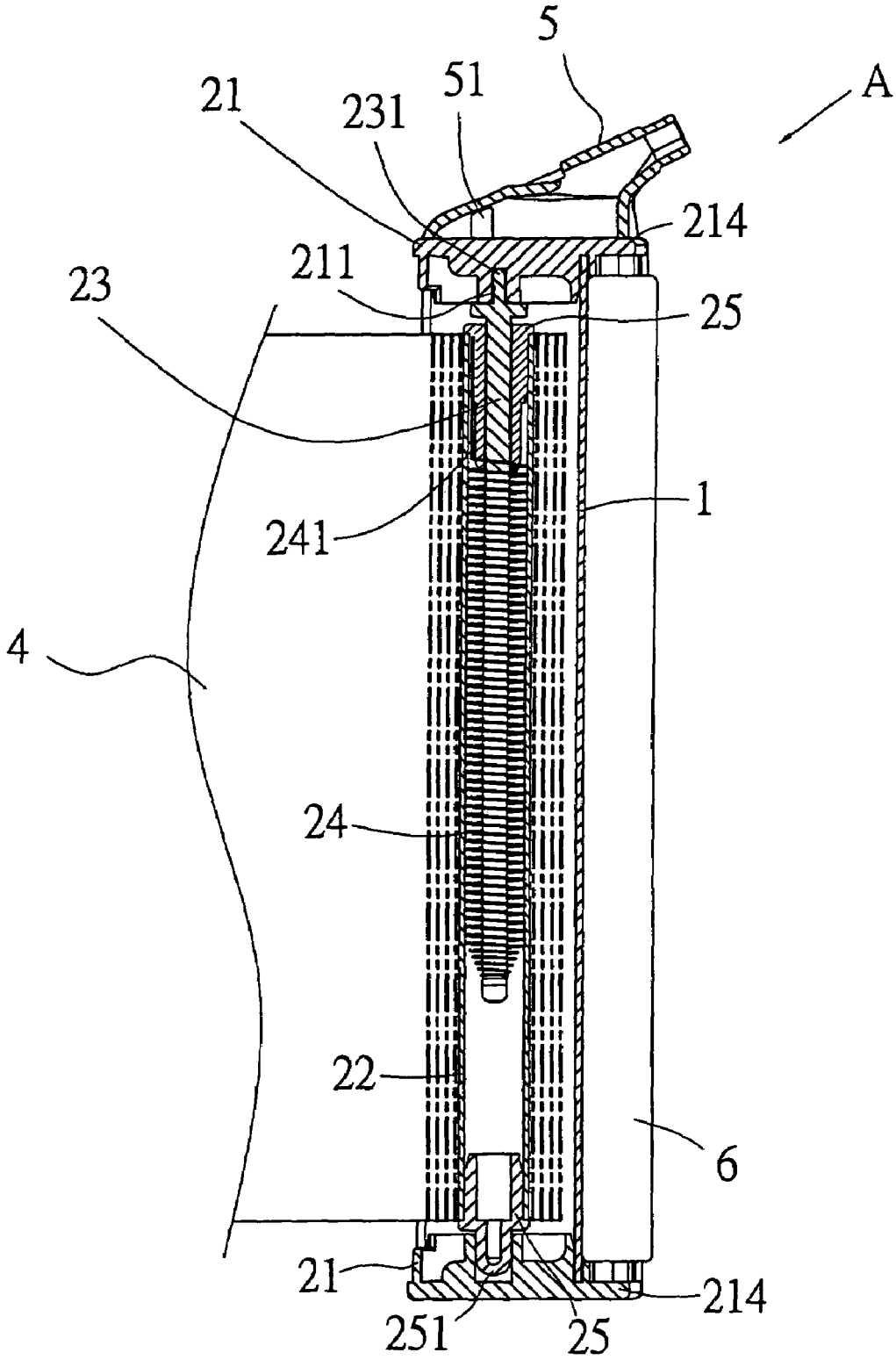
FIG. 3 is a lateral sectional view of the present invention.

Referring to FIGS. 2 and 3 as well, the winding mechanism 2 is positioned in the internal space 13 of the housing sleeve 1, and includes upper and lower locating members 21, a connecting pipe 22, an axial rod 23, a torsion spring 24, and two plugs 25. The upper and the lower locating members 21 are partially inserted in the connecting holes 111 of the housing sleeve 1 so as to be securely joined to the upper and the lower ends of the housing sleeve 1 respectively. The upper locating member 21 has a locating hole 211 on an inner side, a connecting hole 213 on an outer side thereof, and a holding portion 214, which is adjacent to one end of the hollow receiving portion 14 of the housing sleeve 1. The lower locating member 21 has a receiving hole 212 on an inner side, and a holding portion 214, which is adjacent to the other end of the hollow receiving portion 14 of the housing sleeve 1.

The axial rod 23 is received in the torsion spring 24, and the torsion spring 24 and the axial rod 23 together are positioned in the connecting pipe 22. The torsion spring 24 has an end leg 241. The plugs 25 are securely joined to upper and lower ends of the connecting pipe 22 respectively, and the torsion spring 24 is connected to an upper one of the plugs 25 at the end leg 241. The axial rod 23 has a connecting protrusion 231 at an upper end thereof, and sticks out through the upper plug 25 at the upper end, and it is joined to the upper locating member 21 with the connecting protrusion 231 thereof being inserted in the locating hole 211 of the upper locating member 21. The lower plug 25 has an axial protrusion 251, which is received in the receiving hole 212 of the lower locating member 21 for allowing the lower plug 25 to rotate relative to the lower locating member 21.

The whistle 5 has a connecting tenon part 51, and it is securely joined to the upper locating member 21 on the upper end of the housing sleeve 1 with the connecting tenon part 51 being inserted in the connecting hole 213. And, the light-producing member 6 is held in the hollow receiving portion 14 of the housing sleeve 1, and held in position at two ends by means of the holding portions 214 of the upper and the lower locating members 21. Furthermore, the light-producing member 6 can be a glow stick or a shining stick including light emitting diodes. Therefore, the user doesn't have to buy and carry separate whistles or glow sticks.

Figure 4:
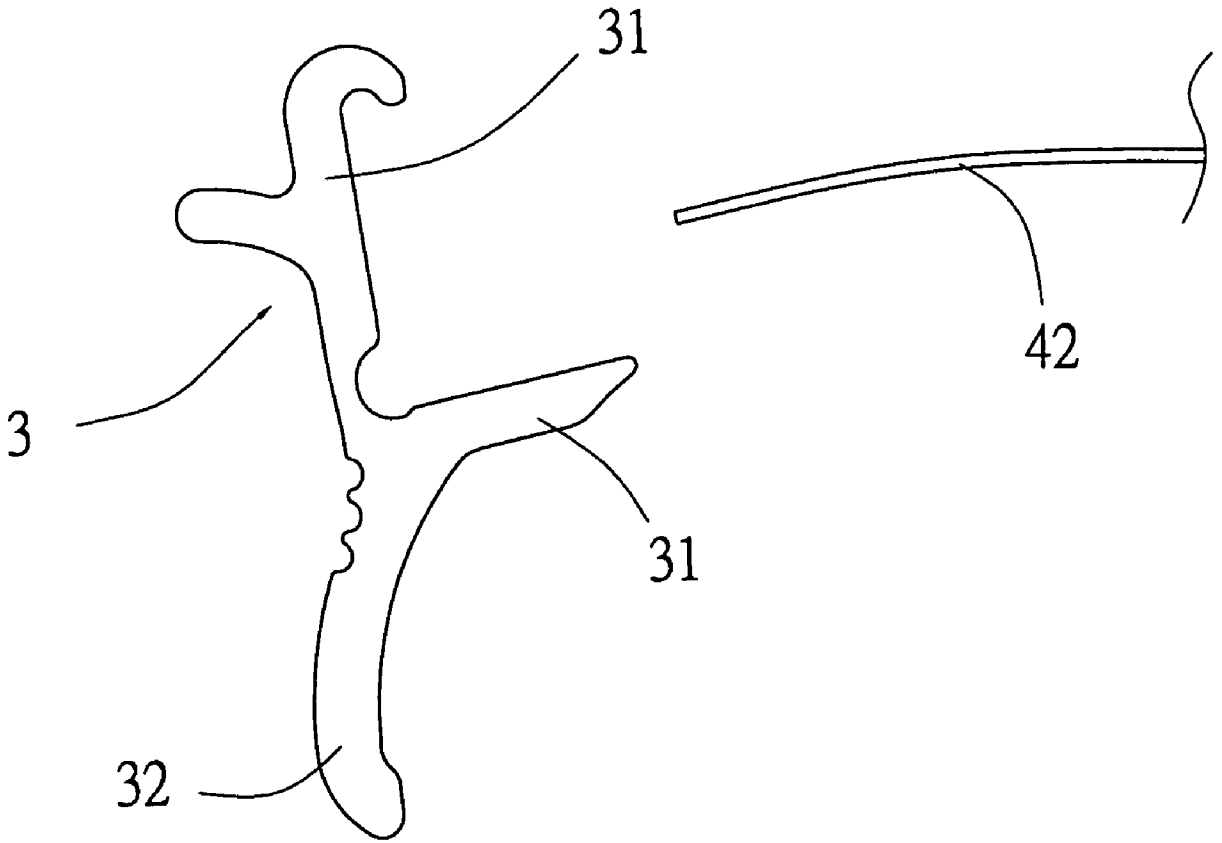
FIG. 4 is a partial top view of the present invention.

Referring to FIG. 4 as well, the pulling rod 3 substantially has a band-shape, and includes two adjacent sandwiching plate parts 31, and a pulling part 32 sticking from one of the sandwiching plate parts 31, and several connecting holes 33 on the pulling part 32.

Figure 5:
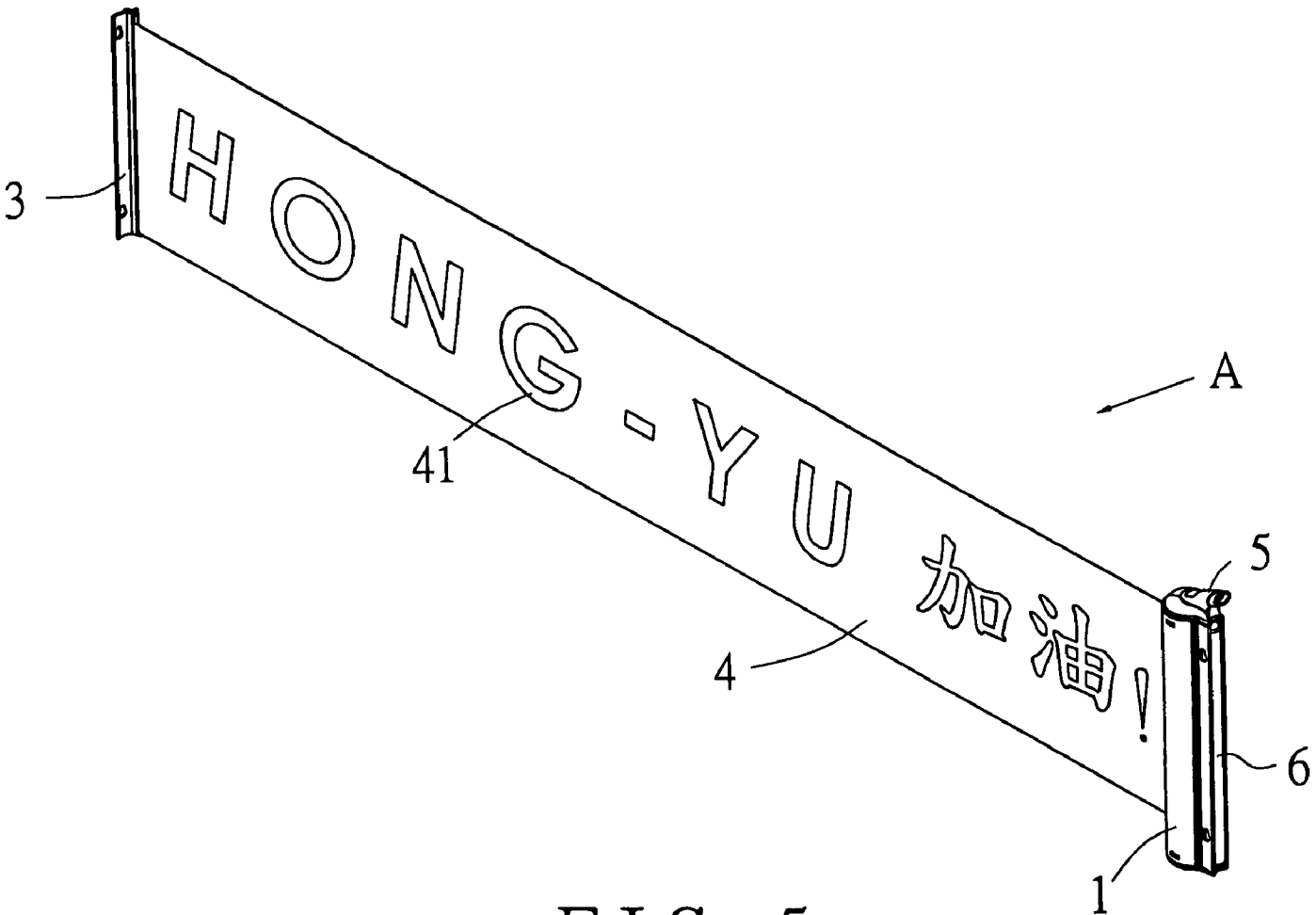
FIG. 5 is a view of the present invention in use (1)
Figure 6:
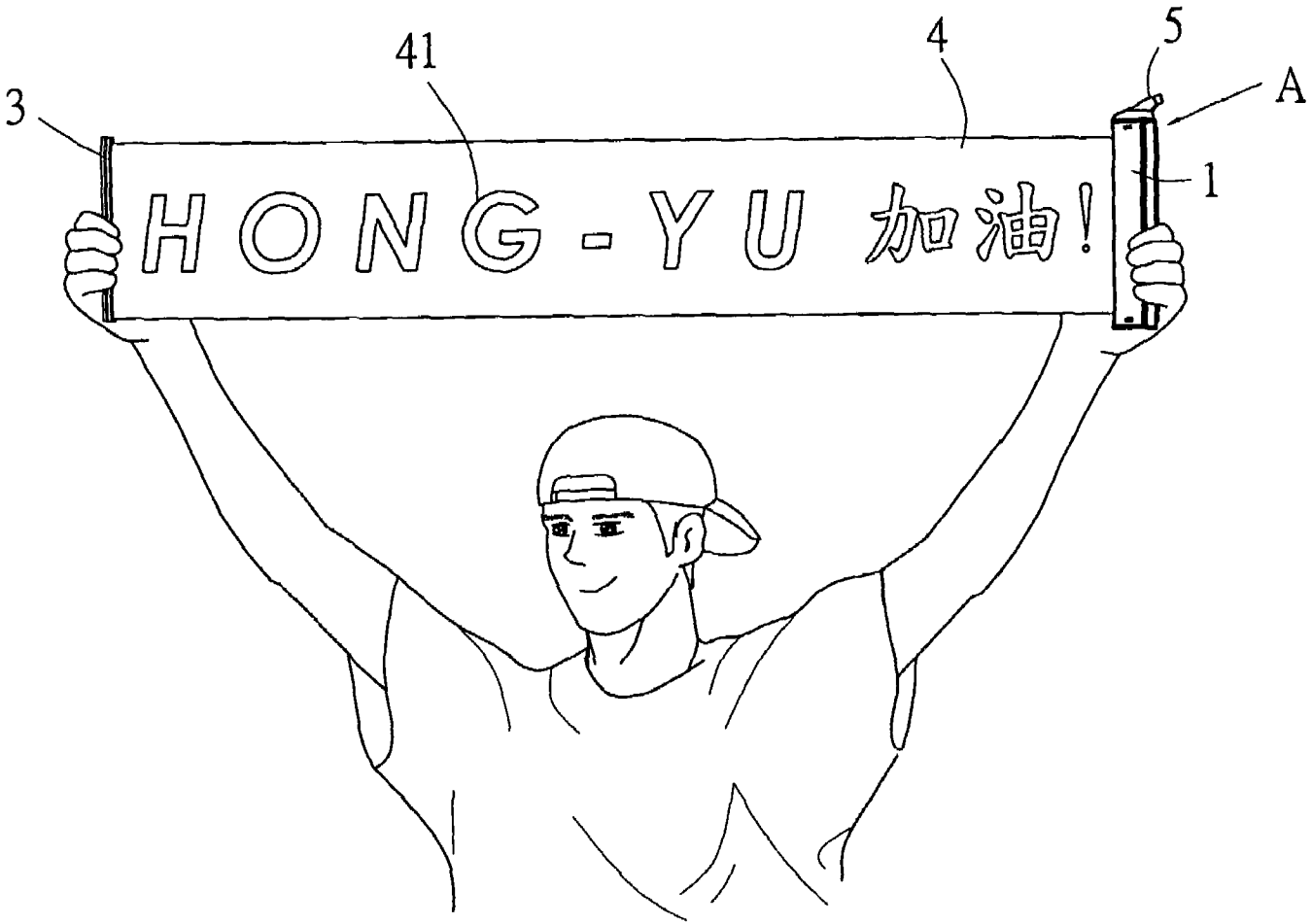
FIG. 6 is a view of the present invention in use (2)
Figure 7:
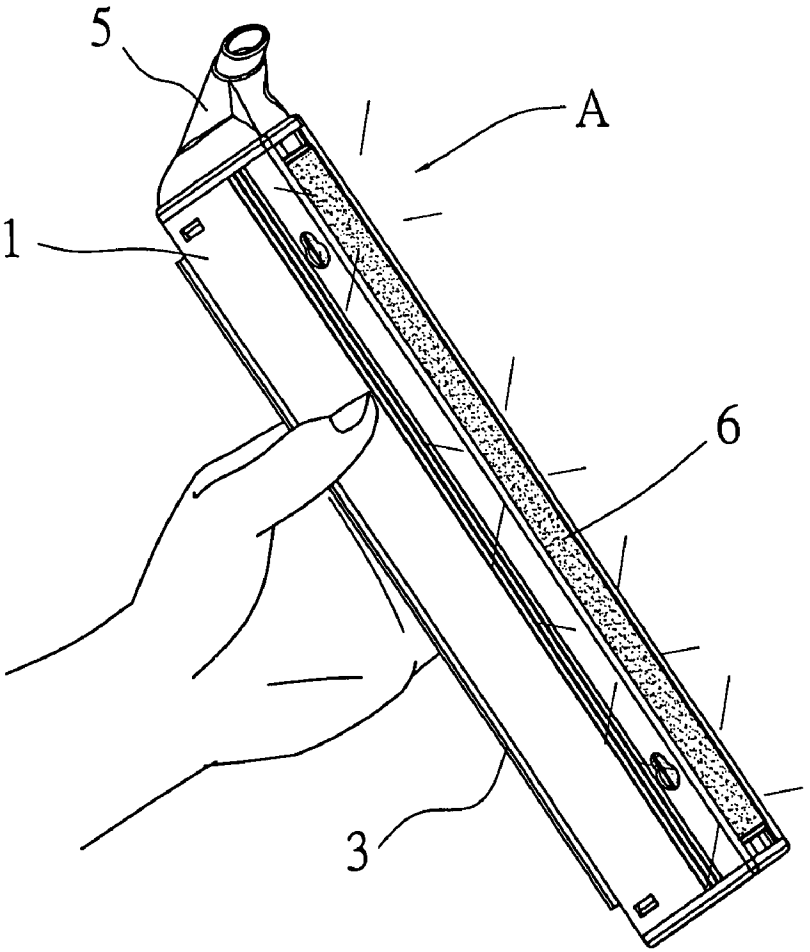
FIG. 7 is a view of the present invention in use (3)
Figure 8:
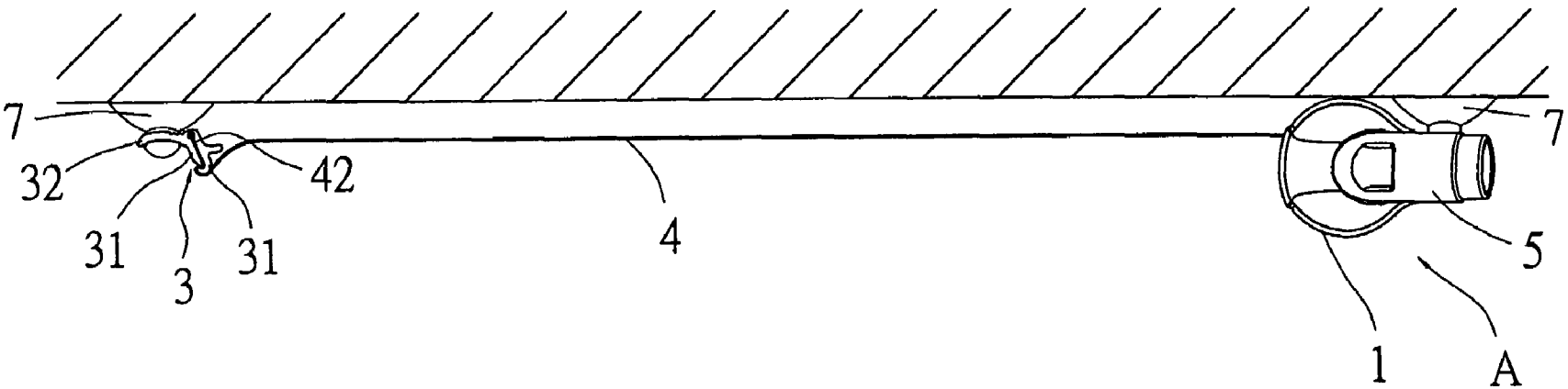
FIG. 8 is a view of the present invention in use (4).

The banner 4 is printed with words and images 41, e.g. names and pictures of candidates for elections, signatures of performers, subjects of and information about various activities, and other advertisements (as shown in FIG. 5). The banner 4 has first and second connecting sections 42 at two ends thereof. In assembly, the first connecting section 42 of the banner 4 is positioned between the adjacent sandwiching plate parts 31 of the pulling rod 3, and next the sandwiching plate parts 31 are pressed together to sandwich the first connecting section 42 of the banner 4 so that the banner 4 is securely joined to the pulling rod 3 at the first end. Furthermore, the second connecting section 42 of the banner 4 is made into a cylinder by means of sewing, and passed into the internal space 13 of the housing sleeve 11 through the lengthways extending gap 12 as well as being positioned around and connected to the connecting pipe 22; thus, the banner 4 is joined to the connecting pipe 22 at the other (second) end. There is no possibility for wrinkles to form on the banner 4 when the banner 4 is not-in-use and stored. And, the banner 4 doesn't have to be folded up for storage; the appearance of a banner is prone to be spoiled if the banner is folded up.

The fixing units 7 can be sucking discs, and each has an insertion pole part 71, and they are securely joined to the housing sleeve 1 and the pulling rod 3 with the insertion pole parts 71 thereof being inserted in respective ones of the connecting holes 15 and 33.

The banner 4 is normally wound around the connecting pipe 22 by the winding mechanism 2. To open and use the publicity scroll (A) of the present invention, first the user moves the housing sleeve 1 and the pulling rod 3 away from each other to spread out the banner 4; thus, words and images 41 printed on the banner 4 can be seen, which can be names of candidates, signatures of performers, themes of various activities or advertisements; when the housing sleeve 1 and the pulling rod 3 is being moved away from each other, the plugs 25 will be rotated together with the connecting pipe 22 joined to the banner 4, and in turn the torsion spring 24 is twisted, and rotational energy is stored in the torsion spring 24; the banner 4 will be automatically wound around the connecting pipe 22, and the publicity scroll (A) closed after the user stops exerting force on the housing sleeve 1 and the pulling rod 3. And, the user is also allows to produce sound with the whistle 5, and the light-producing member 6 will produce light to help attract attention. The publicity scroll (A) can be used as a glow stick instead after the banner 4 has been rolled up around the connecting pipe 22 by the winding mechanism 2.

Furthermore, the publicity scroll (A) can be fixed to stationary objects such as vehicles and walls by means of the fixing units 7 if it needs to be used for a long period of time.

From the above description, it can be seen that the present invention has the following advantages:

1. The banner publicity words and images on the banner can be clearly seen because the banner is connected to and supported by the pulling rod and the connecting pipe of the winding mechanism respectively, and two ends of the banner will be kept in a straight position, and the users allowed to hold the housing sleeve and the pulling pipe instead of the banner after the scroll is spread out.

2. The banner will be automatically rolled up around the connecting pipe for easy storage by means of the winding mechanism when the pulling rod is released. Therefore, there is no possibility for wrinkles to form on the banner when the banner is not-in-use and stored. And, the banner doesn't have to be folded up for storage; the appearance of a banner is prone to be spoiled if the banner is folded up.

3. The publicity scroll has the light producing member and the whistle fitted on the housing sleeve thereof therefore it is relatively convenient to use; the user doesn't have to buy and carry separate whistles or glow sticks.

What is claimed is:

1. Structure of a publicity scroll, comprising a housing sleeve;

a whistle securely joined to one end of the housing sleeve;

a winding mechanism housed in the housing sleeve;

a pulling rod; and a banner interposed between the winding mechanism and the pulling rod, the banner being printed with words and images.

2. The publicity scroll structure as recited in claim 1, wherein the housing sleeve has a hollow receiving portion on one side, and a light producing member is held in the hollow receiving portion of the housing sleeve.

3. The publicity scroll structure as recited in claim 2, wherein the light producing member is a glow stick.

4. The publicity scroll structure as recited in claim 2, wherein the light producing member is a shining stick including light emitting diodes.

5. The publicity scroll structure as recited in claim 1 further comprising a plurality of fixing units; the fixing units being each fitted on one of the housing sleeve and the pulling rod.

6. The publicity scroll structure as recited in claim 1, wherein the pulling rod includes two adjacent plate parts, and a pulling part sticking from one of the plate parts; one end of the banner being sandwiched between the adjacent plate parts of the pulling rod in order for the banner to be securely joined to the pulling rod.

7. Structure of a publicity scroll, comprising:

a housing sleeve, the housing sleeve being a hollow cylinder-shaped housing; the housing sleeve having an internal space; the housing sleeve having on one side thereof a lengthways extending gap communicating with the internal space; the housing sleeve having connecting holes on upper and lower ends thereof;

a first and a second locating member being partially inserted in the connecting holes of the housing sleeve so as to be securely joined to the upper and the lower ends of the housing sleeve respectively; the first locating member having a locating hole on an inner side thereof; the second locating member having a receiving hole on an inner side thereof;

a winding mechanism housed in the housing sleeve;

a pulling rod; and a banner interposed between the winding mechanism and the pulling rode the banner being printed with words and images;

the winding mechanism including:

a connecting pipe connected to a first end of the banner;

an axial rod and a torsion spring, one of the axial rod and the torsion spring being positioned around other one of the axial rod and the torsion spring; the torsion spring and the axial rod together being positioned in the connecting pipe; the axial rod having a connecting protrusion on an upper end thereof, the axial rod being joined to the first locating member with the connecting protrusion being fitted in the locating hole of the first locating member; and a first and a second plug securely joined to upper and lower ends of the connecting pipe; the torsion spring being joined to one of the first and the second plugs at an end leg thereof; the second plug having an axial protrusion; the axial protrusion being received in the receiving hole of the second locating member joined to the lower end of the housing sleeve for allowing the second plug to rotate relative to the second locating member.

8. The publicity scroll structure as recited in claim 7, wherein the housing sleeve has a hollow receiving portion on other side thereof, and the first and the second locating members each has a holding portion; the holding portions of the first and the second locating members being adjacent to upper and lower ends of the hollow receiving portion of the housing sleeve respectively; a light producing member being held in the hollow receiving portion of the housing sleeve, and held in position at upper and lower ends thereof by the holding portions of the first and the second locating members.

9. The publicity scroll structure as recited in claim 7, wherein the first locating member has a connecting hole thereon, and a whistle is securely joined to the first locating member; the whistle having a connecting tenon part inserted in the connecting hole of the first locating member.

* * * * *